United States Patent [19]

Proctor

[11] Patent Number: 4,600,459

[45] Date of Patent: Jul. 15, 1986

[54] PROCESS FOR CONSTRUCTING COMPACT LONGITUDINAL CONCRETE

[76] Inventor: Edward A. Proctor, 3417 Clarendon Rd., Cleveland Heights, Ohio 44118

[21] Appl. No.: 769,447

[22] Filed: Aug. 26, 1985

Related U.S. Application Data

[63] Continuation-in-part of Ser. No. 360,346, Mar. 22, 1982, abandoned.

[51] Int. Cl.[4] ..... B28B 1/14; B28B 7/06

[52] U.S. Cl. ..... 156/212; 52/743; 52/746; 156/216; 156/245; 249/50; 249/139; 264/31; 264/35; 264/219; 264/267; 264/297.1; 264/313; 264/316

[58] Field of Search ..... 264/31, 35, 219, 267, 264/297.1, 313, 316; 156/212, 216, 245; 249/50, 139; 52/743, 746

[56] References Cited

U.S. PATENT DOCUMENTS

| | | | |
|---|---|---|---|
| 692,331 | 2/1902 | Neracher | 264/316 X |
| 3,066,376 | 12/1962 | Pennell, Jr. | 264/316 |
| 3,479,704 | 11/1969 | Reed | 264/267 X |
| 3,792,830 | 2/1974 | Dashen et al. | 249/28 |

*Primary Examiner*—Jan Silbaugh

[57] ABSTRACT

A new and novel process for constructing longitudinal concrete members such as beams by providing a longitudinal sack like mold constructed from a pliable sheet or sheets having an open throat supported by an open rim frame in turn supported by a plurality of inverted "U" shaped supports spaced apart one from another while in a common straight alignment while the supports rest upon an equipment base. The concrete members being either removed from the sack like mold, or the member being a cast in place member with the mold acting as a casing or protective skin. The sack like mold being a hybrid sling because of being provided with a long under loop support on which the loop portion of the true sling rests.

15 Claims, 28 Drawing Figures

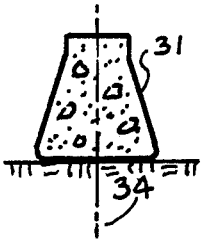
FIG 2
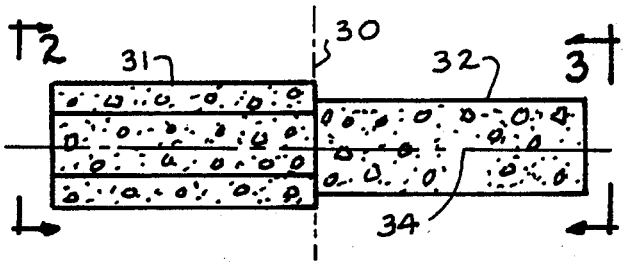
FIG. 1
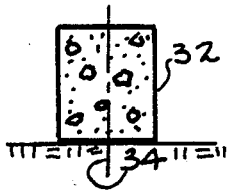
FIG. 3
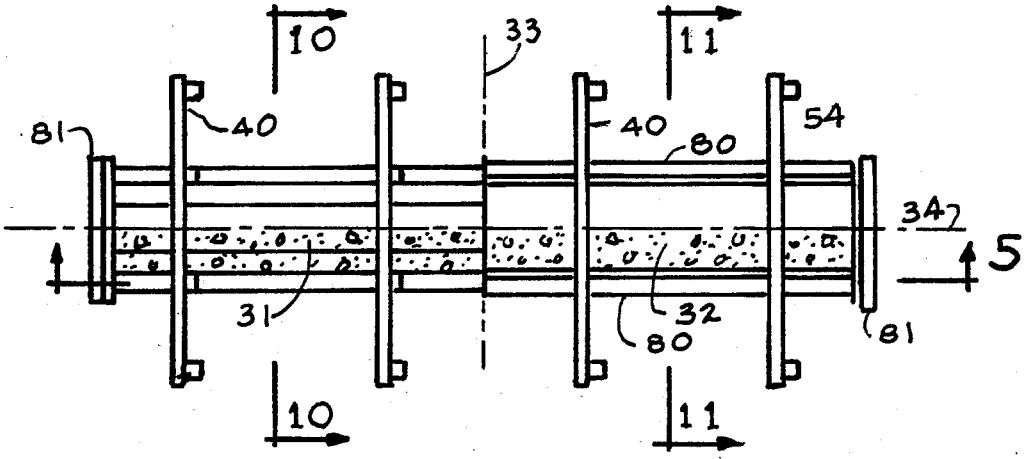
FIG. 4
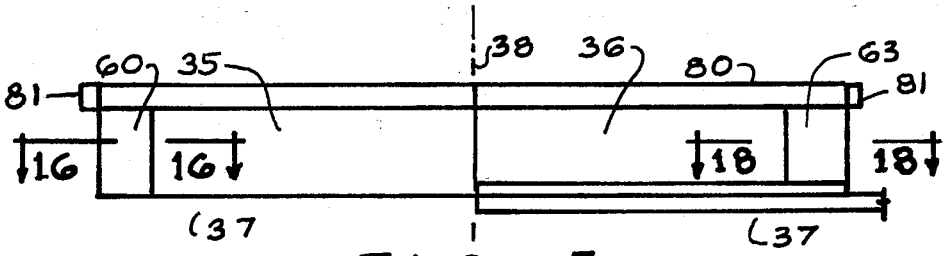
FIG. 5
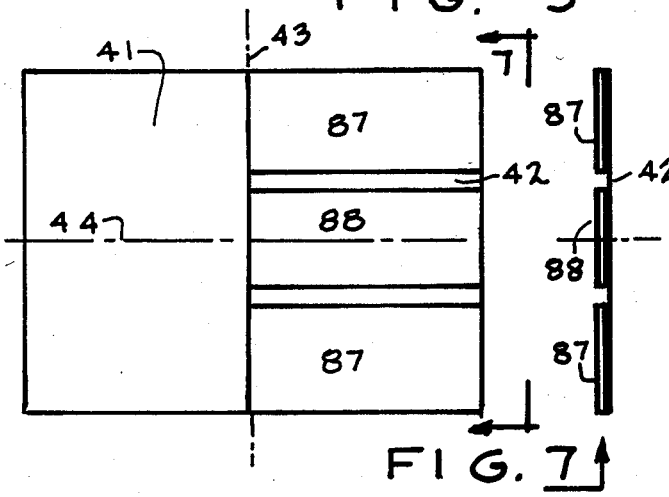
FIG. 6
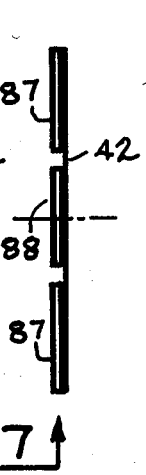
FIG. 7
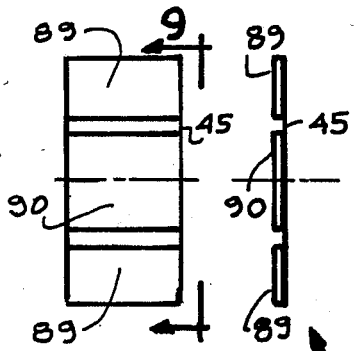
FIG. 8
FIG. 9

PROCESS FOR CONSTRUCTING COMPACT LONGITUDINAL CONCRETE

This application is a continuation-in-part application of application Ser. No. 360,346 filed Mar. 22, 1982 and now abandoned.

My new and novel process for constructing a compact concrete member derives both its novelty and vast scope of usefulness from the process means itself and also from the inherent qualities of the new and novel materials utilized in performing the new process. The concrete members mentioned in the above paragraph are intended to be directed chiefly to long compact concrete beams. Although with reservation of the knowledge that my process can be directed to constructing other compact concrete members such as columns piles, street curbs, walls and the like, compact beams will be conveniently utilized as examples.

Since it is expedient to select one common well know species of concrete member as an example in describing and explaining my invention it should be understood that my invention has a broader scope than the chosen example illustrates.

The basic first object of my invention is to reduce the cost of constructing long compact concrete members such as beams by drastically reducing their forming costs by reducing both form construction labor and material costs. My new process uses form materials cheaper than those materials presently used. My new process requires very few junctures between interconnecting form elements; whereas present day form construction requires a multitude of junctures between interconnecting form parts. Any juncture between form parts required in my process is made by a quick cheap manual operation requiring no special skills or tools.

The basic first object of my invention is further enhanced since my process uses a reusable partially suspended horizontal hybrid sling mold, which mold is easily and quickly stripped away from a concrete first member cast within the hybrid sling mold, and thereafter requires a minimal amount of labor to return the mold to its original condition in which again a second concere member can again be formed.

A second important object of my invention is possible because of the inherent qualities of the materials used in my new process. This second object of my invention is to improve the curing environment for concrete members by depositing fluid concrete into an impervious elongated partially suspended horizontal hybrid sling, wherein the thus confined fluid concrete is isolated from contact with the atmosphere and weather. This confinement will produce a desirable longer concrete time setting interval with resulting higher strength being imparted to the concrete.

The basic second object of my invention is further enhanced since my process uses an impervious elongated partially suspended horizontal hybrid sling with an under loop support as a mold, now concrete members such as concrete beams can be constructed out-of-doors because the impervious pliable sheet construction of the mold will protect the confined fluid concrete from the weather such as wind and rain, with a simple expedience of covering only the top of the confined concrete.

The basic second object of my invention is further enhanced since my process uses an impervious elongated partially suspended horizontal sling with an under loop support as a mold. This sling because of its impervious nature can be placed in water saturated soil or even below the ground water level or below the top surface of a body of water and thereafter filled with fluid concrete 6 which will be isolated from the water by the impervious mold. This inherent quality of the material used in my new process expands the environment conditions under which my process can be utilized.

A basic third object of my invention is to utilize my process as a means for constructing longitudinal compact concrete beams and similar members suitable for exterior use because of being provided with an impervious casing protection from wind, rain and snow. Such members or beams cannot be considered as new beams but can only be considered as members or beams having acquired new qualities because of the process by which they are made.

In summation my new process provides for more economical construction for concrete members, of higher strength because of improved curing environment, constructed under both favorable and adverse environmental situations, in reusable molds, while the member itself is suitable for either interior or exterior use, while also being adaptable for precast, poured in place or a combination of precast and poured in place construction.

Other objects and advantages of my invention will be apparent from the following description taken in conjunction with the accompanying drawings wherein like parts are referred to by like reference characters and in which like reference characters refer to like parts: and wherein:

BRIEF DESCRIPTION OF DRAWINGS

FIG. 1 is a plan view showing at the left of center line 30 of a first longitudinal compact concrete beam 31 and at the right of center line 30 a second longitudinal compact concrete beam 32

FIGS. 2 and 3 are end views taken along respective lines 2—2 and 3—3 as shown on FIG. 1 and looking in the direction of the attached arrows.

FIG. 4 is a plan view of rim frame support equipment 40 utilized in my process. FIG. 4 shows at the left hand side of the center line 33 the construction the first concrete beam 31, further shown in FIGS. 2 and 10. At the right hand side of the center line 33 is a plan view of rim frame support equipment 40 utilized in my process for constructing the second concrete beam 32 further shown in FIGS. 3 and 11. The beams 31 and 32 have a longitudinal centerline 34.

FIG. 5 is an elevation view of the partially suspended horizontal first and second hybrid slings 35 and 36 having a sling loop supported by an under loop support 37. At the left hand side of the centerline 38, the under loop support 37 is the earth at the bottom of an excavation trench 39 shown on FIG. 10. At the right hand side of the centerline 38 the under loop support 37 is a concrete slab. The elevational view of FIG. 5 is taken along line 5—5 as shown on FIG. 4 and looking in the direction of the attached arrows shows what would appear when the rim frame support equipment 40 is omitted leaving the hybrid slings 35 and 36 alone. At the left hand side of the centerline 34 the partially support hybrid sling 35 is as shown on FIG. 10. At the left hand side of the centerline 34 the partially supported hybrid sling 36 is as shown on FIG. 11.

FIG. 6 is a plan view of a first and second broad pliable sheets 41 and 42 at the respective left hand and right hand sides of the centerline 43. The sheets 41 and 42 have a common breath centerline 44 and are used in making the first portions of the respective hybrid slings 35 and 36.

FIG. 7 is an end view of FIG. 6 as shown by line 7—7 and looking in the direction of the attached arrows while showing the second pliable sheet 42 used in making the first portion of the second hybrid sling 36.

FIG. 8 is a plan view of the third pliable sheet 45 used in making the second wrap around end closure 63 of the partially supported second hybrid sling 36 which is also shown on FIGS. 5 and 18.

FIG. 9 is an end view of the third pliable sheet 45 taken along line 9—9 as shown on FIG. 8 and looking in the direction of the attached arrows.

The first wrap around and closure 60 shown on FIG. 5 at the left of centerline 38 is also made from the third pliable sheet 45.

Figure 10:
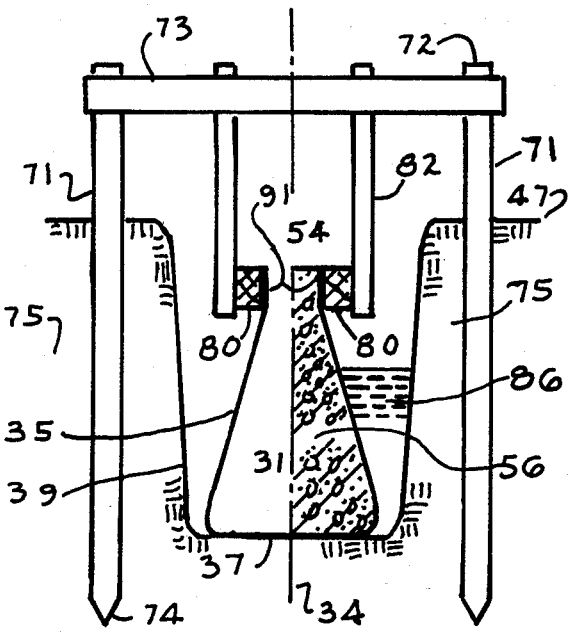

FIG. 10 is a cross-sectional view taken along line 10—10 as shown on FIG. 4 and looking in the direction of the attached arrows. It shows the first hybrid sling 35 in which is constructed the first compact concrete beam 31 previously shown in FIG. 2. FIG. 10 shows the equipment base 47 for rim support equipment 40. The equipment base 47 is at a higher elevation than the under loop support 37.

Figure 11:
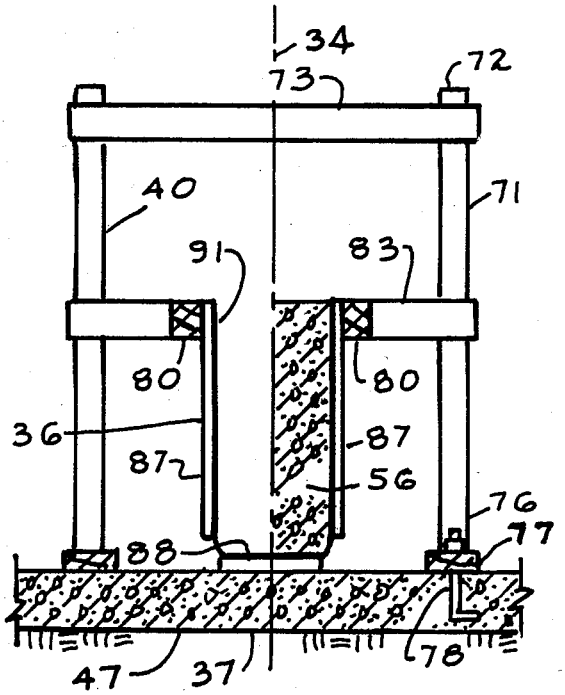

FIG. 11 is a cross sectional view taken along line 11—11 as shown on FIG. 4 and looking in the direction of the attached arrows. FIG. 11 shows the second hybrid sling 36 in which is constructed the second compact concrete beam 32 previously shown on FIG. 3. FIG. 11 shows the equipment base 47 for the rim frame support equipment 40. The equipment base 47 is at the same vertical elevation as the under looop support 37. Both the base 47 and support 37 being jointly serviced by a concrete floor slab.

Figure 12:
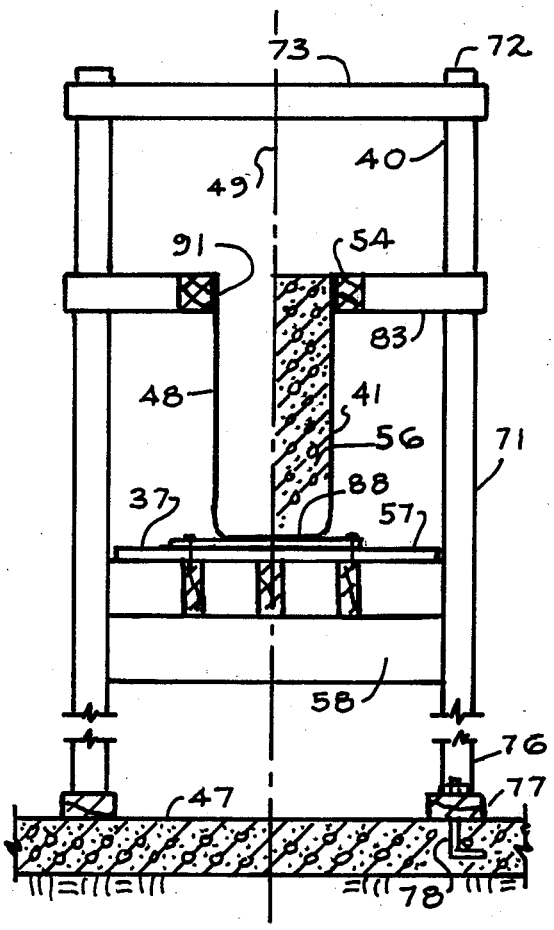

FIG. 12 is a cross-sectional view of a third hybrid sling 48 shown at the left hand side of centerline 49. While showing that the under loop support 37 is approximately one building story higher than the support base 47 for the rim frame support equipment 40. The under loop support 37 is also the floor 57 of an elevated platform 58.

Figure 13:
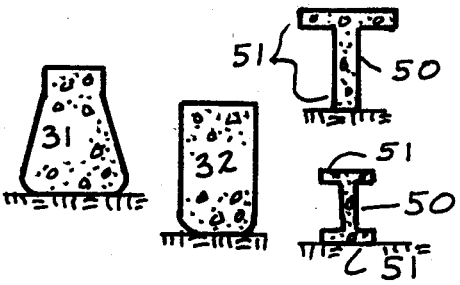

FIG. 13 shows several cross sectional view of two compact concrete beams 31 and 32 in contrast to non compact concrete beams 50 having various projections 51 such as flanges and web which give the noncompact beams 50 their distinguishing noncompact nature.

Figure 14:
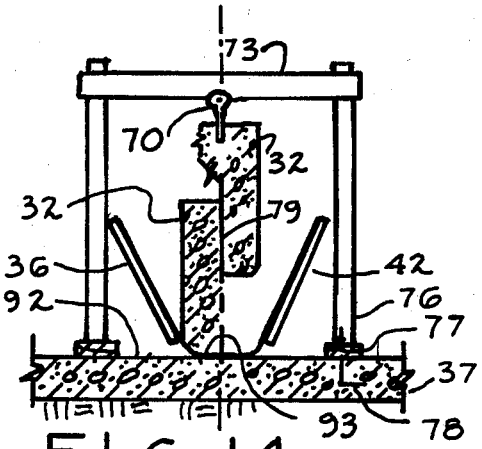

FIG. 14 shows the easy means by which the hybrid sling 36 can be stripped away from the compact concrete beam 32. The stripped beam 32 is easily removed from the hybrid sling mold 36 by simply lifting the beam vertically by use of an eye lifting lug 70 as shown.

Figure 15:
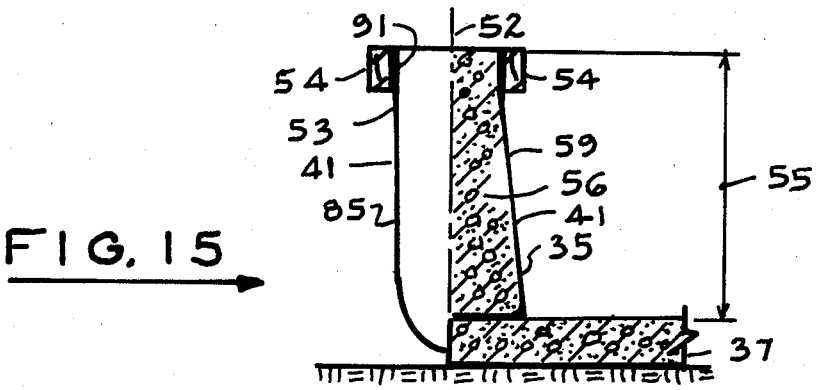

FIG. 15 at the left side of centerline 52 shows a true sling 53, haning below and open rim support frame 54. At the right side of centerline 52 is shown under loop support 37 placed at a predetermined depth 55 below the open rim support frame 54.

At the right of centerline 52 is shown my hybrid sling 35 as compared to the true sling 53 shown at the left of centerline 52. The true sling 53 has only support by suspension from the open rim support frame 54. My hybrid sling 35 has partial suspension support from the open rim support frame 54 and a positive vertical support supplied by its under loop support 37.

The weight of fluid concrete 56 placed into the true sling 53 would have to be entirely supported by suspension means from the open rim support frame 54.

My hybrid sling 35 at the right of centerline 52 when filled with fluid concrete 56 would have its weight of the concrete completely directly supported by the under loop support 37.

It is true that the fluid concrete 56 confined within both the true sling 53 and my hybrid sling 35 will except lateral pressures resisted by the confining true sling 53 and hybrid sling 35.

Since my hybrid sling 35 does not support the weight of the confined fluid concrete 56 it will have adequate reserve strength to resist lateral pressures produced by the confined fluid concrete 56.

If and when the lateral pressures produced by the confined fluid concrete 56 within my hybrid sling form 35 produces excessive or undesired bulging of the sides 59 of the hybrid sling form 35 I intend to provide "stiffener-spreader" boards such 87 88 already shown on FIG. 11.

It is obvious by casual inspection of FIG. 15 and it can be proven through calculations that the pressure on the under loop support 37 is quite intense while the lateral pressures of the confined fluid concrete are very slight upon the sides 59 of the hybrid sling 35.

Figure 16:
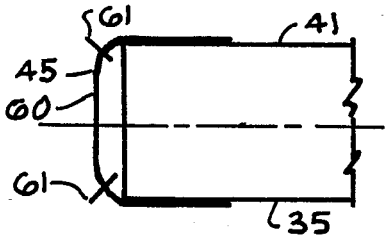

FIG. 16 shows an enlarged plan of a first wrap around end closure 60 with two severance lines 61.

Figure 17:
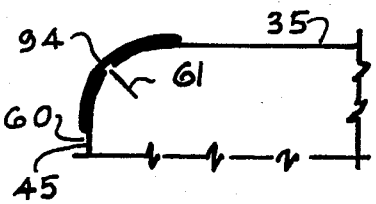

FIG. 17 is an enlarged corner detail of the first wrap around end closure 60 while indicating a severance line 61 along which the third pliable sheet 45 must be cut in order to remove the pliable sheets 41 and 42 from the beam 31 or 32 as was shown in FIG. 14 in order to reuse the hybrid slings 35 and 36 again as a mold form.

Figure 18:
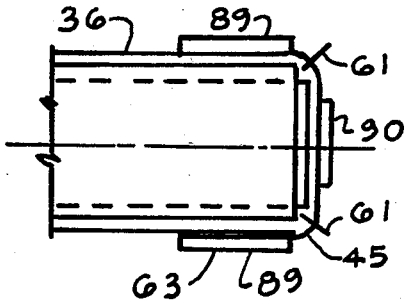

FIG. 18 shows in an enlarged plan a second wrap around end closure 63.

Figure 19:
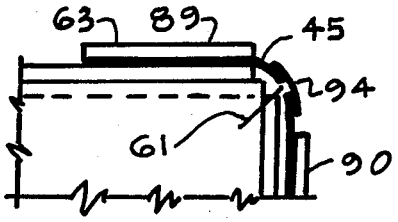

FIG. 19 is an enlarged corner detail of the second wrap around end closure 63 while indicating a severance line 61 along which the third pliable sheet 45 must be cut in order to remove the pliable sheets 41 and 42 from the beam 32.

Figure 20:
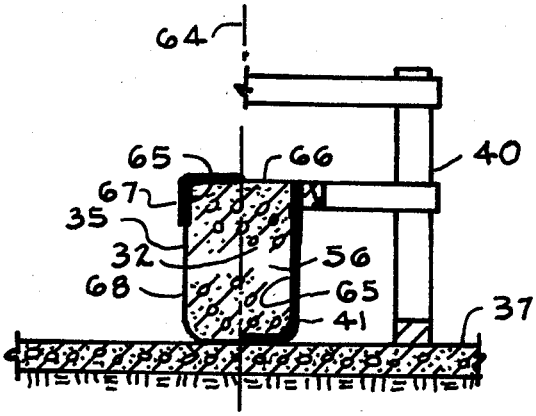

FIG. 20 at the right hand side of the centerline 64 shows the rim frame support equipment 40 and under loop support 37 used to construct the second longitudinal beam 32. The first pliable sheet 41 is coated with a bonding agent 65 prior to placing the fluid concrete 56 into the first hybrid sling 35. After the second longitudinal concrete beam 32 has been constructed the top surface 66 is covered with a pliable plastic cap 67 which has been coated with an adhesive agent 65. The longitudinal compact concrete beam 32 shown in FIG. 20 has a complete plastic encasement 68 protecting the beam from exterior elements such as rain and snow.

Figure 21:
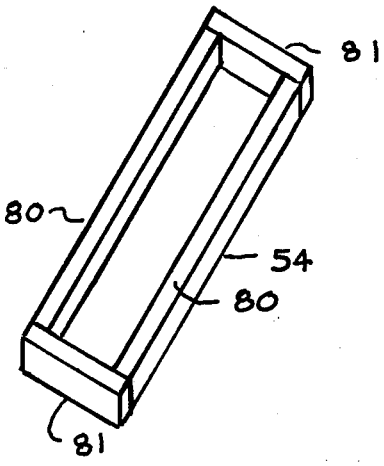

FIG. 21 is an isometric projection plan of the open rim support frame 54.

Figure 22:
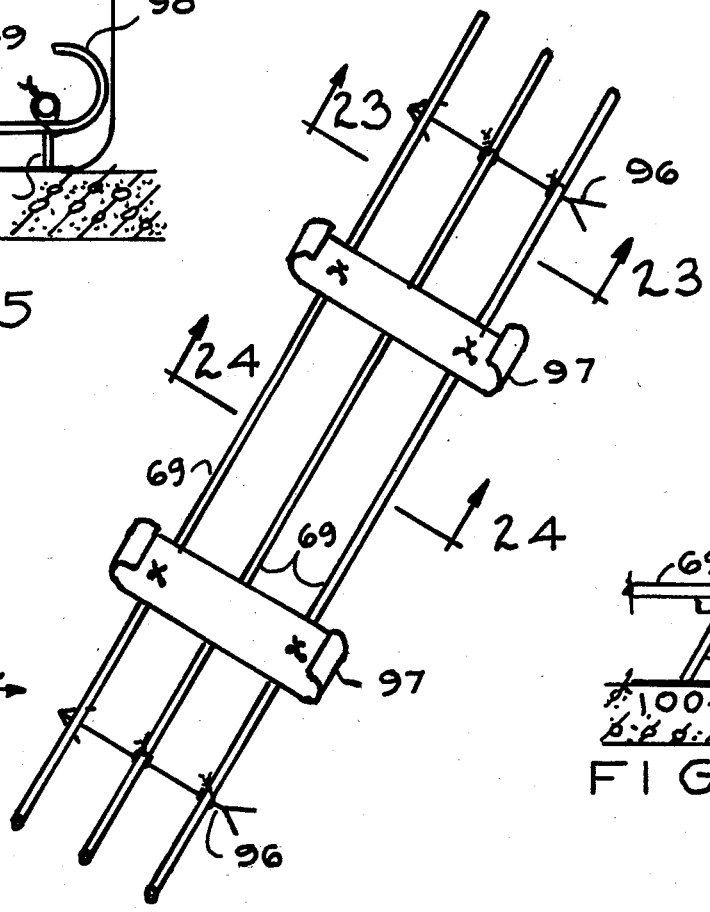

FIG. 22 is an isometric projection plan showing three long reinforcing rods 69 wired to support chairs 96 and also to spreader straps 97.

Figure 23:
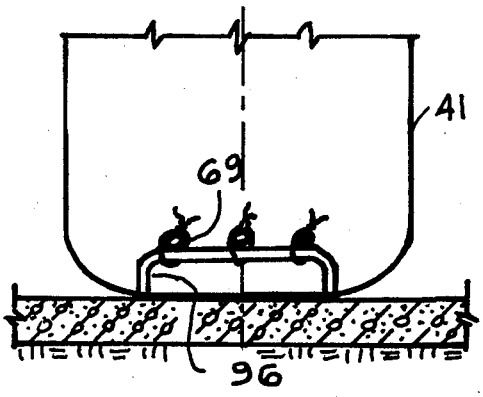

FIG. 23 is a cross-sectional view taken along line 23—23 and looking in the direction of the attached arrows as shown on FIG. 22.

Figure 24:
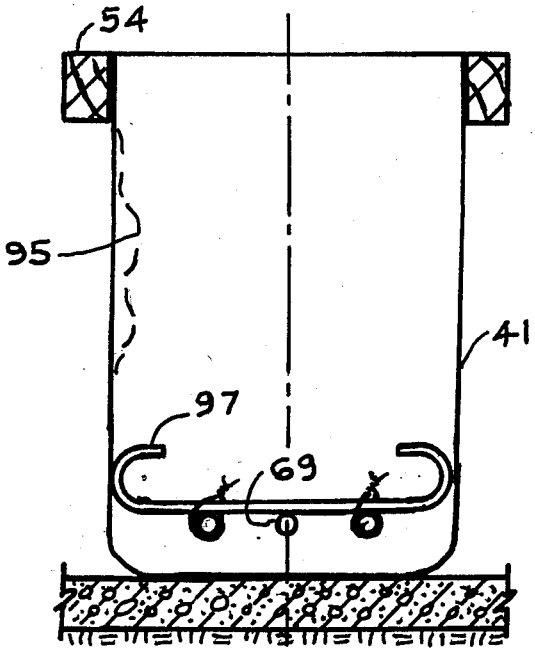

FIG. 24 is a cross-sectional view taken along line 24—24 and looking in the direction of the attached arrows as shown on FIG. 22.

Figure 25:
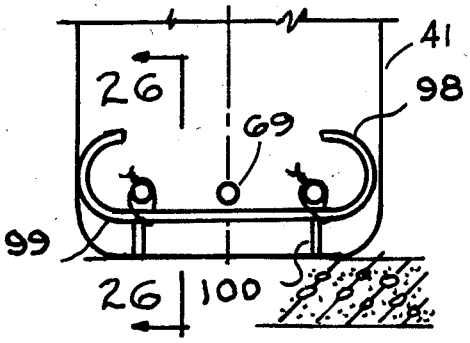

FIG. 25 is a cross-sectional view similar to cross-section shown in FIG. 24 but where the spreader strap 97 becomes a combination spreader-chair device 99 with a spreader strap 98 also used as a chair. Use of spreader straps 97 attached to the reinforcing rods 69 as shown on FIG. 24 or the use of the combination spreader-chair device 99 shown on FIG. 25 with attached legs 100 and also attached to reinforcing rods 69 when lowered down into the undistended hybrid sling forms 35 and 36 push aside wrinkles 95 shown from the pliable sheets 41 and 42. The weight of the reinforcing rods 69 and their attached straps and chairs will retain the loop end of the hybrid slings 35 and 36 upon the under loop support 37 until the subsequently deposited fluid concrete 56 begins to restrain the hybrid slings 35 and 36 upon the support 37 as the fluid concrete enters the bottom of the slings 35 and 36.

Figure 26:
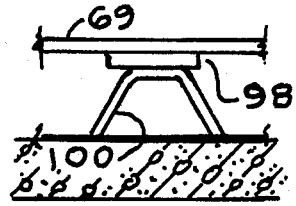

FIG. 26 is a sectional detail taken along line 26—26 as shown in FIG. 25 and looking in the direction of the attached arrows. Support legs 100 are shown attached to spreader strap 98.

Although FIGS. 16 through 19 illustrate wrap around end closures for my hybrid slings 35 and 36; which represent my preferred end closures, alternate rigid end closures can also be used.

Figure 27:
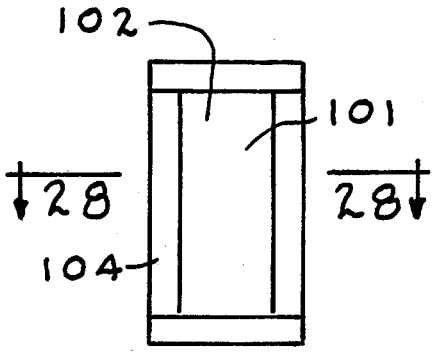

FIG. 27 is an end view of an alternate rigid end closure.

Figure 28:
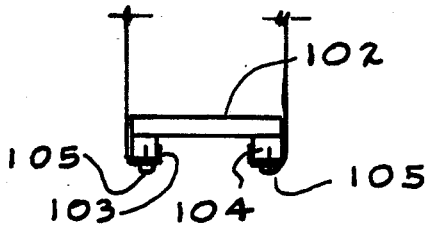

FIG. 28 is a cross sectional view taken along line 28—28 as shown on FIG. 27 and looking in the direction of the attached arrows.

DETAILED DESCRIPTION OF INVENTION

FIG. 1 is a plan view showing at the left of the centerline 30 a first longitudinal compact concrete member 31 and at the right of centerline 30 a second longitudinal compact concrete member 32. The first and second compact concrete members for the purpose of explaining my invention have respectively been selected as having a trapezoid and square or rectangular cross-section as shown in FIGS. 2 and 3. The cross-sectional configurations of the two beams 31 and 32 have no relationship to my inventive process therein presented. Although I indicate variations in my process when describing the construction process of the beams 31 and 32 either beam can be constructed as described applying to it; or can be constructed as described applying to the other companion beam. The only requirement necessary in applying my process is that it be used in constructing compact concrete members and not be used in constructing noncompact members, as later described in FIG. 13.

FIGS. 2 and 3 as stated previously are end views taken along respective lines 2—2 and 3—3 as shown on FIG. 1 and looking in the direction of the attached arrows.

FIG. 4 is a plan view of rim frame support equipment 40 utilized in my process. The rim frame support equipment 40 in addition to being shown in FIG. 4 is shown in more detail in FIGS. 10 and 11 which are sectional views taken from FIG. 4, and also in FIG. 21. The rim frame support equipment 40 comprises two spaced apart uprights 71 spaced apart one from another at equal distances from a common centerline 34 which is also a first alignment, the uprights 71 have upper ends 72 interconnected by a horizontal tie beam 73. In FIG. 10 the uprights 71 have lower pointed ends 74 driven into the earthen bank 75 of the excavation trench 39. The earthen banks 75 act as the equipment base 47. In FIG. 10 the under loop support 37 is the bottom of the excavation trench 39 and is at a lower elevation than the equipment base 47 which is the top of the earthen banks 75.

Referring to FIG. 11 the uprights 71 have lower ends 76 resting on while attached thereto a sill 77 attached by anchor bolts 78 to the under loop support 37 which in FIG. 11 also serves as the equipment base 47. Therefore in FIG. 11 the under loop support 37 and support equipment base 47 are at the same vertical elevation.

The support equipment 40 also includes the rim support frame 54 made up of two longitudinal side rails 80 terminating at short end rails 81 as shown in FIG. 21. FIG. 10 shows vertical first support arms 82 supporting the rim support frame 54. FIG. 11 shows horizontal second support arms 83 supporting the rim support frame 54.

FIG. 5 is an elevational view taken along line 5—5 on FIG. 4 and looking in the direction of the attached arrows. FIG. 5 shows the partially supported hybrid slings 35 and 36 having a sling loop 85 as shown in FIG. 15 resting upon an under loop support 37, which under loop support 37 at the left of the centerline 38 is the bottom of an excavation trench 39, while at the right of centerline 38 it is a concrete floor slab. FIG. 5 shows no difference in the top elevation of under loop supports 37 one to another. FIG. 5 shows respective first and second wrap around end closures 60 and 63 further illustrated in FIGS. 16 and 18.

FIG. 5 in conjunction with FIGS. 4, 10 and 11 shows that the rim frame support equipment 40 supporting the rim support frame 54 is essential to performing my process because the rim support frame 54 partially supports the hybrid sling whether it be hybrid sling 35 or 36. The hybrid slings 35 and 36 contrary to a true sling 53 have a loop portion 85 supported by an under loop support 37 as is shown in FIGS. 10, 11 and 15. Fluid concrete 56 at the right hand side of centerlines 34 and 52 in respective FIGS. 10, 11 and 15 shows the hybrid slings 35 and 36 confining the fluid concrete 56.

FIG. 6 as stated previously is a plan view of spread out first and second broad pliable sheets 41 and 42 at the respective left and right hand sides of the centerline 43. The sheets 41 and 42 have a common breath centerline 44. The sheets 41 and 42 are used in making the first portions of the respective hybrid slings 35 and 36. The pliable sheets 41 and 42 may or may not be impervious to the passage of water.

Returning to FIG. 10 when the ground water table is higher than the bottom of the excavation trench 39, water 86 will seep into the trench 39 as is shown at the right hand side of centerline 34. The presence of the impervious sheet 41 confining the fluid concrete 56 does not allow the water 86 to leach the Portland cement out of the fluid concrete 56 and thus destroying the concrete. The same thing would apply to an impervious sheet 42. FIG. 6 shows the second pliable sheet 42 as having stiffener-spreader boards 87 and 88 adhesively attached to the sheet 42. The stiffener-spreader boards 87 and 88 serve a dual purpose. FIGS. 6 and 7 show stiffener-spreader boards 87 and 88 adhesively attached to the second pliable sheet 42. The boards 87 and 88 are adhesive coated on one upper side then the sheet 42 is laid over the adhesive coated surfaces, then brushed free from wrinkles and creases. The boards 87 and 88 are considered as spreader boards because they serve to eliminate wrinkles and creases within the sheet 42. Upon inspection of FIG. 11 it is obvious that the confined fluid concrete 56 will exert lateral pressures distending the sheet 42 sidewards. The stiffener-spreader boards 87 will resist these lateral pressures.

FIGS. 8 and 9 show a third pliable sheet 45 used in making the second wrap around end closure 63. The second wrap around end closure 63 has adhesively attached stiffener-spreader boards 89 and 90 as also shown on FIG. 18.

FIGS. 5 and 16 shows the first wrap around end closure 60 comprising sheet 41 without the stiffener-spreader boards 89 and 90.

FIG. 12 is a cross-sectional view of a third hybrid sling 48 shown at the left hand side of the centerline 49. The under loop support 37 is approximately one building story higher than the equipment base 47. The under loop support 37 is the floor 57 of an elevated platform 58. The floor 57 has nailed to it stiffener spreader board 88.

The rim frame support equipment 40 shown in FIG. 12 comprises uprights 71 being long vertical shores having upper ends 72 interconnected by a horizontal tie beam 73. The uprights 71 have lower ends 76 resting on while being attached to a sill 77 attached by anchor bolts 78 to the equipment base 47. The uprights 71 have attached second support arms 83 supporting the rim support frame 54. The third hybrid sling 48 has the first pliable sheet 41 with adhesively attached stiffener spreader board 88 nailed to floor 57.

FIGS. 10, 11 and 12 respectively show the hybrid slings 35, 36 and 48 having pliable sheet edges 91 attached by an attachment means to the rim support frame 54.

FIG. 13 shows cross-sectional views of compact concrete beams 31 and 32 in contrast to noncompact beams 50 having projections 51 such as flanges and webs.

FIG. 14 shows how easily the hybrid sling mold 36 can be stripped away from the second longitudinal compact concrete beam 32. This permits removal of the beam 32 from its confining hybrid sling mold 36. FIG. 14 also shows the sling mold 36 with a centerline 79 meeting the top surface 92 of the under loop support 37 whereto a bottom portion 93 of the sling mold 36 is adhesively attached to the top surface 92. The compact concrete beam 32 is lifted up by lifting eye lug 70.

FIG. 15 at the left hand side of centerline 52 shows a true sling 53 hanging below an open rim support frame 54 with the pliable sheet edges 91 attached by attachment means to the rim support frame 54. At the right hand of the centerline 52 an under loop support 37 is placed at a predetermined depth 55 below the open rim support frame 54. The thus intercepted true sling 53 is no longer a true sling but now becomes a hybrid sling. Because the sling is now supported by the under loop support 37 as well as being suspended below the open rim support frame 54, all fluid concrete 56 placed into the true sling 53 would have to be supported by suspension from the open rim support frame 54. At the right hand side of the centerline 52 the hybrid sling 35 confines the fluid concrete 56 but the weight of the fluid concrete is supported by the under loop support 37. The fluid concrete upon being confined within the hybrid sling 35 does exert lateral pressures which must be resisted by the first pliable sheet 41 as is also the case with the true sling 53.

FIG. 16 shows an enlarged plan of a first wrap around end closure 60 with severance lines 61. The hybrid sling 35 and the first wrap around end closure 60 are respectively made from the first pliable sheet 41 and the third pliable sheet 45 shown on FIGS. 6 and 8. It is necessary to cut the wrap around closure 60 at severance lines 61 in order to strip the hybrid sling mold 35 away from the beam 32 as is shown on FIG. 14.

FIG. 17 is an enlarged corner detail showing how the severed hybrid sling mold 35 can be returned to its original assembly condition and be so retained by application of the adhesive strip 94.

FIG. 18 shows an enlarged plan of the second wrap around end closure 63 with severance lines 61. The hybrid sling 36 is made from the second pliable sheet 42 as shown in FIG. 6. The second wrap around end closure 63 is made from the third pliable sheet 45 with the attached stiffener-spreader boards 89 and 90. The severed hybrid sling mold 36 can be returned to its original assembly condition and be so retained by application of the adhesive strip 94 shown on FIG. 19.

FIG. 20 at the right hand side of centerline 64 shows the rim frame support equipment 40 and under loop support 37 used to construct the second longitudinal beam 32. The first pliable sheet 41 is coated with a bonding agent 65 prior to placing the fluid concrete 56 into the first hybrid sling 35. After the longitudinal concrete beam 32 has been constructed and the fluid concrete has gained a set, its top surface 66 is covered by a pliable plastic cap 67 which has been recently coated with an adhesive agent 65. The longitudinal compact concrete beam 32 as shown in FIG. 20 has a complete plastic encasement 68 protecting the beam from exterior weather elements such as rain and snow. Such a beam is suitable for use as a member of an exterior structure.

FIG. 21 is an isometric projection plan of the open rim support frame 54 being a part of the rim frame support equipment 40. The rim support frame 54 has two parallel side rails 80 terminating at short end rails 81.

FIG. 22 is an isometric projection plan showing three long reinforcing rods 69 wired to support chairs 96 and also to spreader straps 97.

FIG. 23 is a cross-sectional view taken along line 23—23 of FIG. 22 and looking in the direction of the attached arrows. FIG. 23 shows the reinforcing rods 69 wired to the support chair 96.

FIG. 24 is a cross-sectional view taken along line 24—24 of FIG. 22 and looking in the direction of the attached arrows. FIG. 24 shows the reinforcing rods 69 wired to the spreader strap 97. FIG. 24 indicates how wrinkles 95 shown by dotted lines are displaced.

FIG. 25 is a cross-sectional view similar to FIG. 24 but new spreader strap 98 is part of a combination spreader-chair device 99.

FIG. 26 is a sectional detail taken along line 26—26 as shown on FIG. 25 and looking in the direction of the attached arrows. FIG. 26 shows the combination spreader-chair device 99 having attached legs 100.

FIG. 27 is an end view of an alternate rigid end closure 101 comprising a rigid sheet 102 having periphery edges 103 attached to a rectangular frame 104. The pliable sheet 41 is wrapped over the frame 104 and attached thereto by tacks 105.

FIG. 28 is a cross-sectional view taken along line 28—28 as shown on FIG. 27 and looking in the direction of the attached arrows.

I claim:

1. A process for constructing a compact longitudinal first concrete member, the process using four consecutive steps of providing and using a partially suspended horizontal hybrid sling with an under loop bearing support, the hybrid sling acting as a mold confining fluid concrete, the hybrid sling having an open throat at its upper end attached to an open rim frame, the sling loop having a long central body portion between two end closures, the central body portion with its two attached end closures making a closed ended trough-like mold container used in constructing the first concrete member, the first step consists in providing a pliable sheet, the sheet being used in making the central body portion, the second step consists in providing rim support equipment for partially suspending the hybrid sling, the support equipment requiring a long narrow rectangular horizontal open rim frame, having two spaced apart parallel side rails terminating at short end cross rails while the rim frame is supported at a predetermined height above said under loop bearing support, by rim frame support equipment resting upon an equipment base, the support equipment consisting of a plurality of inverted "U" shaped supports spaced apart one from another along a common alignment centerline, each "U" support having two uprights spaced apart one from another at equal distances transverse to said alignment centerline, the uprights having upper ends interconnected by a cross-tie beam while having lower ends resting on said equipment base, the third step comprises assembling and attaching an end closure to each end of the sling portion, to create a closed end trough-like compartment having an upper rectangular pliable rim edge, the third step further consists in placing the trough-like compartment beneath the rim frame and attaching the rectangular pliable rim edge to the frame, while the hybrid sling central body portion hangs downward such that the bottom of its loop rests upon the under loop bearing support and where at the bottom of the loop is spread out evenly without wrinkles and creases, the fourth step consists of ingressing a first pour of fluid concrete through the open rim frame into the undistended closed ended hybrid sling whereby the thus confined fluid concrete provides fluid pressures distending the hybrid sling to produce uniform cross-sectional configurations along the length of the now distended hybrid sling, the fluid concrete upon gaining a set produces a long compact concrete member having the same cross-sectional configurations along its length.

2. A process for constructing a compact longitudinal concrete member, the process entailing four consecutive steps, the first step providing a first and two second pliable sheets, the second step consisting of providing rim support equipment for the hybrid sling made from the pliable sheets, the third step consisting of assembling and attaching the first and second hybrid sling portions together at four common corner junctures to create a closed ended reusuable trough-like compartment, the fourth step consisting of ingressing a first pour of fluid concrete into the closed ended compartment wherein the fluid concrete upon gaining a set creates the first concrete member as set forth in claim 1 wherein; the second pliable sheets are cut at or adjacent to the four common corner junctures, the cut portions of the reusable trough like mold compartment thereafter being peeled from and separated from the first concrete member which is then removed from the compartment, the cut portions being reassembled again by application of an overlapping adhesive coated tape at each juncture cut, the bottom bearing closed ended hybrid sling is again reassembled as per original step 3 and reused as per original step 4 of claim 1 to construct a second compact concrete member.

3. A process for constructing a compact longitudinal concrete member, the process comprising four consecutive steps, the first step providing a pliable sheet and two end closures, each end closure consisting of a rigid sheet having a periphery frame, the second step consisting of providing rim support equipment for the hybrid sling portion made from the pliable sheet, the third step consisting of assembling and attaching the hybrid sling portion to the two end closures by tacking the pliable sheet to the closures at four common corner junctures to create a closed ended reusable trough-like compartment, the fourth step consisting of ingressing a first pour of fluid concrete into the trough-like compartment wherein the fluid concrete distends the hybrid sling and upon gaining a set creates the first concrete member as set forth in claim 1 wherein; the hybrid sling portion at its four common juncture corners has all tacks removed, the thus disengaged portions of the reusable trough-like mold compartment thereafter being peeled from and separated from the first concrete member which is then removed from the disassembled compartment, the disassembled portions thereafter being reassembled again by reinserting the tacks at each juncture, thus the bottom bearing closed ended hybrid sling is again assembled as per original step 3, and reused as per original step 4 of claim 1 to construct a second compact concrete member.

4. A process for constructing a compact longitudinal first concrete member by performing four consecutive steps of providing and using a partially suspended hybrid sling having an under loop bearing support as set forth in claim 1 wherein; said under loop bearing support and said rim support equipment base are positioned at one common vertical elevation.

5. A process for constructing a compact longitudinal first concrete member by performing four consecutive steps of providing and using a partially suspended hybrid sling having an under loop bearing support as set forth in claim 1 wherein; said under loop bearing support is at a lower elevation than said rim support equipment base.

6. A process for constructing a compact longitudinal first concrete member by performing four consecutive steps of providing and using a partially suspended hybrid sling having an under loop bearing support as set forth in claim 1 wherein; said under loop bearing support is at a higher elevation than said rim support equipment base.

7. A process for constructing a compact longitudinal first concrete member by performing four consecutive steps of providing and using a partially suspended hybrid sling having an under loop bearing support as set forth in claim 1 wherein; said first pliable sheet has a breadth transverse to its length with a breadth first centerline extending throughout its length, a long narrow rectangular spreader-stiffener first board having one side coated with an adhesive and a second longitudinal centerline, thereafter the first board being placed underneath the first pliable sheet with the adhesive in contact with the sheet while the first and second centerlines are in a common alignment thereafter the first pliable sheet is brushed free from wrinkles and creases while being attached by the adhesive coating to the spreader-stiffener first board.

8. A process for constructing a compact longitudinal first concrete member by performing four consecutive steps of providing and using a partially suspended hybrid sling having an under loop bearing support as set forth in claim 1 wherein; said first pliable sheet has a breadth transverse to its length with a breadth first centerline extending throughout its length, the first sheet also has two spaced apart second centerlines parallel one to another and parallel to the first centerline, two long narrow rectangular spreader-stiffener second boards each having a side coated with an adhesive while having a third centerline along its length, the second boards being positioned underneath the first pliable sheet with the adhesive in contact with the sheet and the second and third centerlines in a common alignment, thereafter the first pliable sheet is brushed free from wrinkles and creases while being adhesively attached to both of the two second spreader-stiffener boards.

9. A process for constructing a compact longitudinal first concrete member by performing four consecutive steps of providing and using a partially suspended hybrid sling having an under loop bearing support, the sling loop being a long central body first portion between two end closure second portions as set forth in claim 1 wherein; first and second pliable sheets respectively have first and second breadths transverse to their lengths with respective first and second centerlines extending throughout their lengths, a first and two second narrow rectangular spreader-stiffener boards respectively have third and fourth centerlines, the first spreader-stiffener board is positioned underneath the first pliable sheet with the first and third centerlines in a common first alignment, thereafter the first pliable sheet is brushed free from wrinkles and creases then attached by attachment means to the spreader-stiffener first board, the two second spreader-stiffener boards are positioned each underneath a second pliable sheet with the second and fourth centerlines in a common second alignment, thereafter the two second pliable sheets are brushed free from wrinkles and creases when each second spreader-stiffener board is thereby attached by attachment means to its second pliable sheet.

10. A process for constructing a compact longitudinal first concrete member by performing four consecutive steps of providing and using a partially suspended hybrid sling having an under loop bearing support as set forth in claim 1 wherein; said under loop bearing support has a longitudinal second centerline being the centerline of both the under loop bearing support and the centerline of a narrow strip of the top surface of the under loop bearing support, which narrow strip is coated with an adhesive coating, said first pliable sheet has a breadth transverse to its length with a breadth first centerline extending throughout its length, the first pliable sheet being positioned on top of the under loop bearing support with its first centerline in a common first alignment with the second centerline, thereafter the first pliable sheet is brushed free from wrinkles and creases while being adhesively attached to the narrow strip portion of the top surface of the under loop bearing support.

11. A process for constructing a compact longitudinal first concrete member by performing four consecutive steps of providing and using a partially suspended hybrid sling having an under loop bearing support as set forth in claim 1 wherein; the closed ended trough-like compartment created by performing step 3 has all interior surfaces coated by an adhesive prior to performance of step 4 wherein the confined fluid concrete during its concrete setting interval is partially protected from a too rapid setting action by an impervious wrapping at the sides and bottom of the first concrete member, upon the fluid concrete gaining a slow set the first concrete member is wrapped on two sides and its bottom by a weather resisting permanent cast in place casing, said pliable sheet in addition to confining fluid concrete, provides a curing aid during the concrete setting interval and thereafter provides a weather resisting casing.

12. A process for constructing a compact longitudinal first concrete member by performing four consecutive steps of providing and using a partially suspended hybrid sling having an under loop bearing support as set forth in claim 1 wherein; the closed ended trough-like compartment created by performing step 3 has all interior surfaces coated with a first adhesive prior to performance of step 4 wherein the confined fluid concrete during its concrete setting interval is partially protected from a too rapid setting action by an impervious first wrapping at the sides and bottom of the first concrete member, upon the fluid concrete gaining a slow set, thereafter a long rectangular third pliable sheet is coated with an adhesive, then placed over the top surface of the member with the third sheets extended edges folded over the top corners of the member to overlap top portions of the sides of the member, thereby providing the concrete member with a complete weather resisting permanent cast in place casing on all member surfaces, the pliable sheet in addition to confining fluid concrete provides a curing aid during the concrete setting internal and thereafter provides a weather resisting casing.

13. A process for constructing a compact longitudinal first concrete beam member by performing four consecutive steps of providing and using a partially suspended hybrid sling having an under loop support as set forth in claim 1 wherein; the third step also provides a preassembled combination reinforcement and spreader means together with it being lowered down to the bottom of the closed ended trough-like compartment, the combination means consists of a plurality of long reinforcing rods with transversely attached support chairs and spreader straps, each strap having a straight central first portion between curved end portions, each chair having a straight central second portion with transversely projecting support legs having leg ends, when positioned at the bottom of the trough-like compartment the chair leg ends are in contact with the bottom of the loop portion of the hybrid sling while also resting through the intermediate sling upon the under loop bearing support.

14. A process for constructing a compact longitudinal first concrete beam member by performing four consecutive steps of providing and using a partially suspended hybrid sling having an under loop bearing support as set forth in claim 1 wherein; the third step also provides a preassembled reinforcement means together with its placement within the closed ended trough-like compartment, the reinforcement means consisting of a plurality of long reinforcing rods with a plurality of transversely attached chairs having a straight central portion with transversely projecting support legs, each leg having an end which when positioned at the bottom of the trough-like compartment is in contact with the loop portion of the hybrid sling while also resting through the intermediate sling upon the under loop bearing support.

15. A process for constructing a compact longitudinal first concrete beam member by performing four consecutive steps of providing and using a partially suspended hybrid sling having an under loop bearing support as set forth in claim 1 wherein; the third step provides a preassembled combination reinforcing with spreader means with leg supports together with its placement within the closed ended trough-like compartment, the combination means consists of a plurality of long reinforcing rods with a plurality of transversely attached spreader straps with attached support legs, each strap having a straight central first portion between curved end portions, each straight central portion having attached two transversely projecting legs resting through the bottom of the hybrid sling on top of the under loop bearing support.

* * * * *